United States Patent [19]

Bottemiller

[11] Patent Number: 4,718,723

[45] Date of Patent: Jan. 12, 1988

[54] ROCKING CHAIR CONSTRUCTION AND METHOD OF MAKING SAME

[75] Inventor: Donald L. Bottemiller, Wadena, Minn.

[73] Assignee: Homecrest Industries Incorporated, Wadena, Minn.

[21] Appl. No.: 902,292

[22] Filed: Aug. 29, 1986

[51] Int. Cl.[4] ..... A47C 3/025

[52] U.S. Cl. ..... 297/265; 248/624; 297/302

[58] Field of Search ..... 297/264, 265, 293, 301, 297/302; 403/109; 248/624, 626

[56] References Cited

U.S. PATENT DOCUMENTS

| | | | |
|---|---|---|---|
| 2,069,456 | 2/1937 | McGowen | 297/293 X |
| 2,164,163 | 6/1939 | Piper | 297/302 X |
| 4,419,025 | 12/1983 | Takahashi | 403/109 X |
| 4,575,150 | 3/1986 | Smith | 297/301 X |

FOREIGN PATENT DOCUMENTS

| | | | |
|---|---|---|---|
| 389680 | 3/1933 | United Kingdom | 297/293 |
| 650188 | 2/1951 | United Kingdom | 297/293 |

*Primary Examiner*—Kenneth J. Dorner
*Assistant Examiner*—Peter R. Brown
*Attorney, Agent, or Firm*—Kinney & Lange

[57] ABSTRACT

A rocking chair has an aluminum frame seat portion that is mounted to a base. A pair of coil springs are attached to the base and are mechanically fastened to the chair portion to provide rocking action to the chair. Preferably, steel tubing is attached to the end of the coil springs with the steel tubing positioned in an overlapping relationship with tubular ends of the chair portion and the steel tubing and the tubular ends being mechanically attached to each other.

2 Claims, 6 Drawing Figures

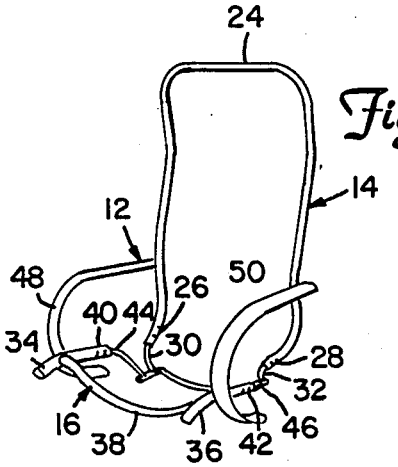
Fig.1A
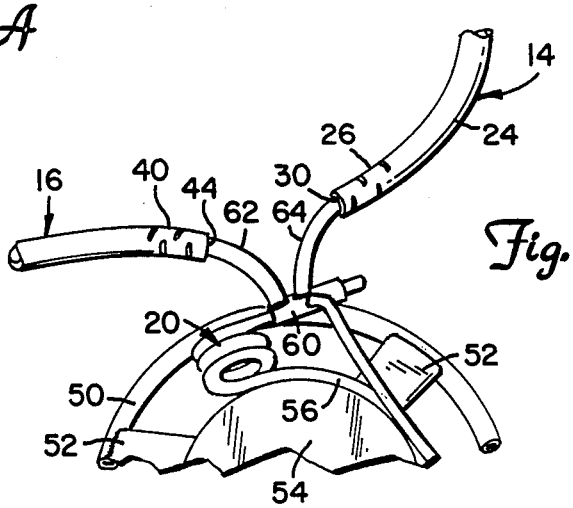
Fig.2
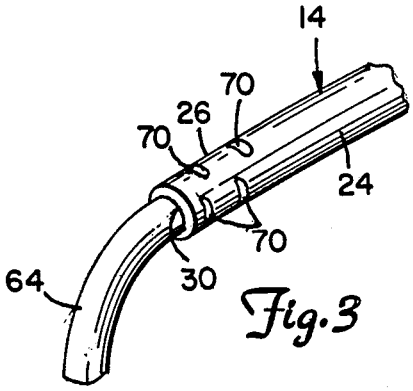
Fig.3
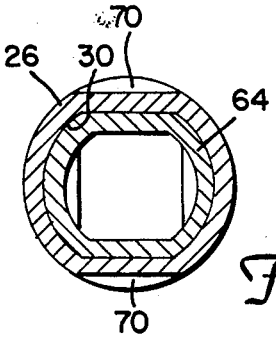
Fig.4
Fig.5
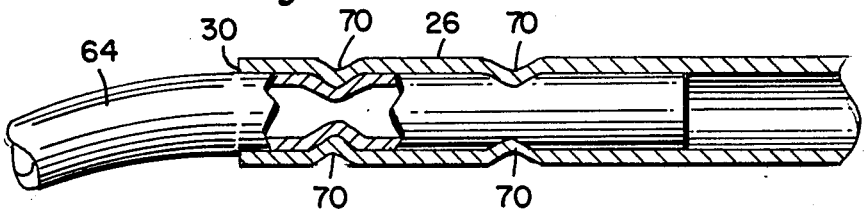

ROCKING CHAIR CONSTRUCTION AND METHOD OF MAKING SAME

BACKGROUND OF THE INVENTION

1. Field of the Invention

The present invention relates to rocking chair constructions. In particular, it relates to a rocking chair construction made of both steel and aluminum.

2. Description of the Prior Art

Rocking chairs having a stationary base have been known for quite some time. A rocking mechanism is provided to allow the chair to rock with respect to the base. Examples of such rocking chairs are illustrated in the et al U.S. Pat. Nos. 2,916,084, the Bottemiller et al. 4,411,468 Apissomian and 4,371,142, Bottemiller et al all assigned to the same assignee as the present application. One rocking mechanism that is often used is a pair of coil springs, such as is described in the Bottemiller et al U.S. Pat. No. 2,916,084. The rocking chairs described in the above-mentioned patents are made of steel tubing and are very durable. Although such rocking chairs have been highly successful commercially, they are quite heavy due to the entire steel construction. It has been proposed that a lighter weight rocking chair, having the same rocking action as a steel rocking chair, would be very desirable.

SUMMARY OF THE INVENTION

The present invention includes a method of making a rocking chair having a pair of substantially parallel steel coil springs. The method includes providing a chair frame structure made of aluminum of an aluminum alloy, with the chair frame structure having a plurality of tubular ends disposed proximate a lower portion thereof. A base is provided having a pair of substantially parallel steel coil springs mounted thereon. Steel tubing is attached to free ends of the coil springs and is positioned in an overlapping relationship with the tubular ends of the chair portion and mechanically fastened thereto.

The present invention also includes a chair construction having a seat portion made of an aluminum framework and a stationary ground-engaging base attached to the aluminum framework by a pair of coil springs fixedly attached to the base at one end and mechanically attached to the aluminum framework at another end.

BRIEF DESCRIPTION OF THE DRAWINGS

FIG. 1A is a perspective view of the chair portion.

FIG. 2 is a perspective view of a portion of the bottom of the chair construction.

FIG. 3 is a perspective view of the attachment of a steel tubing member to an aluminum or aluminum alloy member.

FIG. 4 is a cross sectional view of the attachment of the steel tubing member to the aluminum or aluminum alloy member.

FIG. 5 is a sectional view of the attachment of the steel tubing member to the aluminum alloy member with portions shown whole for purposes of clarity.

DETAILED DESCRIPTION OF THE PREFERRED EMBODIMENTS

Figure 1:
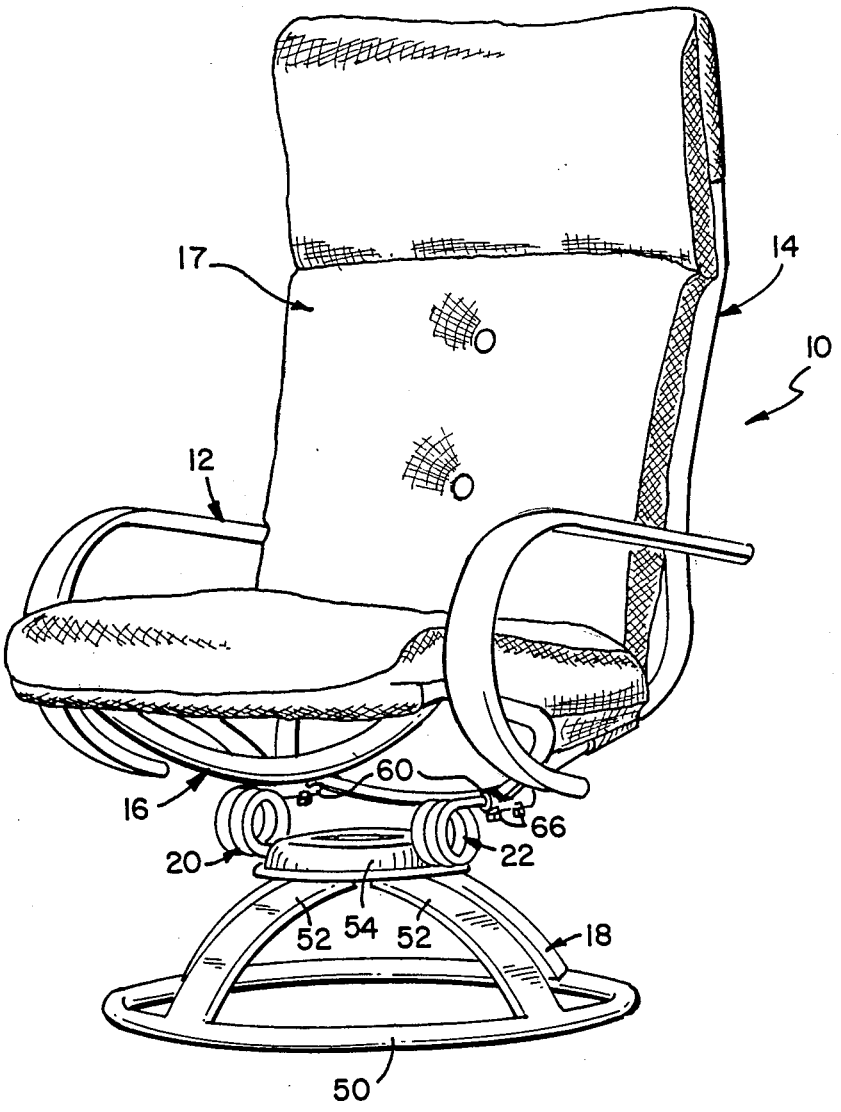
FIG. 1 is a perspective view of the chair construction of the present invention.

A chair construction of the present invention is generally indicated at 10 in FIG. 1. The chair construction includes a chair portion 12 having a back portion 14 and a seat portion 16. A cushion 17 is disposed on the chair portion 12 and preferably rests on plastic or fabric straps (not shown) which are strung on the chair portion 12 in a manner well known. A pair of substantially parallel coil springs 20 and 22 attach the chair portion to a base 18 and provide rocking action to the chair.

The chair portion 12 is made of aluminum or aluminum alloy providing a lightweight construction that is corrosion resistant to the elements. The base 18 is also preferably made of an aluminum or an aluminum alloy for corrosion resistance. The base may also be made of steel to add weight to the chair for stabilizing the chair during rocking. The coil springs 20 and 22 are made of steel since steel provides the type of rocking action desirable in a rocking chair. The combination of an aluminum or aluminum alloy chair portion 12 and a base 18 with steel coil springs provides a rocking chair construction that is both durable and corrosion resistant while providing a desired rocking action.

Referring to FIG. 1A, the chair portion 12 is made of an aluminum or aluminum alloy tubular frame with the back portion 14 being made of a curved tubular frame member 24 being bent to a U-shaped configuration having left and right lower end portions 26 and 28 which have open ends 30 and 32, respectively. The seat portion 16 is preferably made of left and right tubular members 34 and 36 connected by a tubular cross member 38. The members 34 and 36 have rearward end portions 40 and 42 with open ends 44 and 46, respectively.

Left and right arm rest members 48 and 50 are fixedly attached at one end to the tubular member 24 of the back portion 14 and at an opposite end to the chair portion 16. All the members of the chair portion 12 are fixedly attached to each other by well known methods of joining aluminum, such as welding or brazing. It will be understood that the particular configuration of the chair 12 is not particularly important to the present invention, except that the tubular framework has tubular open ends proximate its lower portion.

Referring back to FIG. 1, the base 18, in the preferred form illustrated, has a circular ground-engaging bottom 50 with upwardly and radially extending curved bars 52 joined to a centrally disposed disk-configured member 54. As can easily be seen from FIG. 1, the disk 54 is disposed above the ground-engaging member 50 at a height that positions the chair portion 12 conveniently for sitting.

Springs 20 and 22 are of similar construction and will be described with reference to the coil spring 22 illustrated in FIG. 2. Each coil spring is attached to the disk member 54 at a curved portion 56 that curves around the perimeter of the disk member 54. If the disk member is made of steel, then the curved portion is welded to the disk member 54. If the base is made of aluminum or an aluminum alloy, then the curved portion is attached by a suitable fastener, such as a screw.

In addition, each coil spring has an outwardly extending member 58. The members 58 are in substantial parallel relationship and extending substantially horizontally from the coil springs. Each portion 58 extends through a steel sleeve 60. Attached to each steel sleeve 60 are forward and rearward steel tubing members 62 and 64. The steel tubing member 62 is bent to extend into the open end 44 of the tubular member 40 of the seat portion 16. The steel member 64 is bent rearwardly to extend into the opened end 30 of the end portion 26 of the tubular member 24 of the back portion. A similar sleeve with steel tubing members also extends into the open end 44 of the seat portion 16 and the opened end 30 of the member 24, as best illustrated in FIG. 1A. The sleeves 60 are fixedly attached to the portions 58 of the coil springs by set screws 66, as best illustrated in FIG. 1, or by any other suitable means.

As best illustrated in FIGS. 3–5, wherein the attachment of steel tubing 64 to the opened end portion 26 is illustrated, each steel tubing member extending from the sleeve 60 extends into the aluminum or aluminum alloy end portion a length such that the two tubular members 64 and 24 are crimped as indicated by indentations 70.

The method of the present invention provides for the transition in chair construction of one material to another, such as steel to aluminum, allowing each material to be utilized for what it is best suited. The aluminum or aluminum alloy is used in the chair portion and in the balance of the base to provide lightweight construction that is corrosion resistant. The steel coil springs provide comfortable rocking action to the rocking chair construction.

Although the present invention has been described with reference to preferred embodiments, workers skilled in the art will recognize that changes may be made in form and detail without departing from the spirit and scope of the invention.

What is claimed is:

1. A method of making a rocking chair having a pair of substantially parallel coil springs made of steel, each spring having a terminal end substantially parallel with the base for providing a rocking motion, the method comprising:

providing a chair frame structure made of aluminum or an aluminum alloy construction, the chair frame structure having a chair portion and a back portion, the chair portion having left and right tubular ends and the back portion having left and right tubular ends, all the ends disposed proximate a lower portion of the chair frame structure;

providing an elevated, stationary, ground-engaging base to which the steel coil springs are fixedly attached;

providing a steel sleeve for each coil spring having a pair of steel tubing sections extending away from the sleeve positioned to engage one tubular end of the chair portion and one tubular end of the back portion;

positioning the terminal end of each coil spring through the steel sleeve;

fixedly attaching the steel sleeve to the terminal free end of of the coil spring by set screws;

positioning the tubular ends of the aluminum or aluminum alloy tubing in an overlapping relationship with the corresponding steel tubing sections; and mechanically joining by crimping the aluminum or aluminum alloy tubular ends with the steel tubing section to produce a permanent attachment.

2. An improved rocking chair construction having a chair frame construction, a ground-engaging base and a pair of coil springs and attaching the base to the chair frame construction for providing rocking action to the chair, the improvement comprising:

wherein the ground-engaging base is elevated and the coil springs are steel and disposed substantially parallel to each other and each spring having a terminal end substantially parallel with the base for providing a rocking motion;

the chair frame construction being made of an aluminum or an aluminum alloy construction having a chair portion and a back portion, the chair portion having left and right tubular ends and the back portion having left and right tubular ends, all the tubular ends disposed proximate a lower portion of the frame construction; and means for connecting the chair portion to the steel coil springs including a pair of steel sleeves wherein the terminal ends of the coil springs extend into the steel sleeves and are fixedly attached thereto by set screws and further including two sections of steel tubing fixedly attached to each steel sleeve at one end and extending from the steel sleeve, the steel tubing being in overlapping relationship with a respective tubular end of the seat portion and back portion, wherein the steel tubing and the tubular ends of the seat portion and back portion are joined by being crimped.

* * * * *